US005157224A

United States Patent [19]

Desevaux et al.

[11] Patent Number: 5,157,224

[45] Date of Patent: Oct. 20, 1992

[54] DEVICE FOR HOLDING AND GUIDING A SUB-PROJECTILE IN A CYLINDRICAL CASING AND IN A WEAPON BARREL

[75] Inventors: Michel J. Desevaux; Pierre Ducros, both of Bourges, France

[73] Assignee: GIAT Industries, France

[21] Appl. No.: 531,146

[22] Filed: May 31, 1990

[30] Foreign Application Priority Data

Jun. 1, 1989 [FR] France ..... 89 07232

[51] Int. Cl.[5] ..... F42B 5/045

[52] U.S. Cl. ..... 102/434; 102/430; 102/439; 102/521

[58] Field of Search ..... 102/430, 433, 434, 439, 102/520, 521, 523, 703

[56] References Cited

U.S. PATENT DOCUMENTS

| | | | |
|---|---|---|---|
| H265 | 5/1987 | Bonde et al. | 102/521 |
| 2,971,426 | 2/1961 | Potts . | |
| 3,009,394 | 11/1961 | Kamp et al. | 102/434 |
| 3,476,048 | 11/1969 | Barr et al. | 102/439 |
| 3,735,664 | 5/1973 | Hermle | 102/520 |
| 3,978,792 | 9/1976 | Campoli et al. | 102/430 |
| 4,015,427 | 4/1977 | Evans . | |
| 4,077,147 | 3/1978 | Donnard et al. | 102/439 |
| 4,444,115 | 4/1984 | Romer et al. | 102/430 |
| 4,542,696 | 9/1985 | Bisping et al. | 102/430 |
| 4,738,202 | 4/1988 | Hebert | 102/430 |
| 4,911,079 | 3/1990 | Sauvestre | 102/439 |
| 4,967,668 | 11/1990 | Warren | 102/439 |

FOREIGN PATENT DOCUMENTS

| | | |
|---|---|---|
| 0152492 | 8/1985 | European Pat. Off. . |
| 2606500 | 5/1988 | France . |

*Primary Examiner*—Harold J. Tudor
*Attorney, Agent, or Firm*—Parkhurst, Wendel & Rossi

[57] ABSTRACT

A device for holding and guiding a sub-projectile in a cylindrical casing and in a weapon barrel, which includes a sabot having a sub-projectile within the sabot, a cylindrical casing within which is disposed a projectile, which comprises the sub-projectile and sabot, the sabot having a plurality of arms substantially in the aft section for providing stability and guidance to the projectile inside the weapon barrel, means within the casing for providing stability for the aft section of the projectile, and an annular bush within the fore section of the cylindrical casing cooperating with the fore section of the sabot for providing stability of the sub-projectile.

5 Claims, 7 Drawing Sheets

DEVICE FOR HOLDING AND GUIDING A SUB-PROJECTILE IN A CYLINDRICAL CASING AND IN A WEAPON BARREL

BACKGROUND OF THE INVENTION

1. Field of the Invention

The invention relates to a device for holding a fin-stabilized subcaliber projectile in relation to the casing of a telescoped ammunition round wherein the projectile is confined to the cartridge case.

2. Related Art Statement

Telescoped ammunition, which have given rise to many developments in the last few years, are characterized in that the projectile is disposed inside the cartridge case containing the grain charge instead of protruding outside of the latter.

Generally, the propellant charge is disposed around the projectile and gas-tightness problems arise. Since the projectile is not introduced into the barrel of a weapon when the round of ammunition is in the chamber; instead, it is the pressure due to the combustion of propellant charge gases which will first bring the projectile into position and hen push it inside the barrel.

It is unsatisfactory that, upon firing, combustion gases will precede the projectile before the latter has entered far enough into the barrel to ensure gas-tightness.

Complex solutions have been developed and most of them pertain to a plurality of propellant charges ignite successively as described, for example, in U.S. Pat. No. 4,802,415.

A simpler solution is proposed by U.S. Pat. No. 4,770,098 which describes a round of ammunition wherein a bushing of plastic material closes the fore section of the casing; this bushing of plastic material includes a hole the diameter of which is slightly smaller than that of a full-caliber round.

The sound is, therefore, immobilized by the bushing which thus ensures gas-tightness with respect to the propellant gas from the propellant charge.

However, such a concept will be interesting only if the size of the bushing does not excessively limit the volume reserved for the propellant charge.

For this concept to be applied to a round of ammunition wherein the projectile is of the fin-stabilized, subcaliber type and contained in a sabot, it is then necessary to design a sabot of the "drawer" type, which means that the resultant of the forces brought to bear on the sabot by propellant gases has an application point ahead of the projectile center of gravity.

As a matter of fact, the "full caliber" section of such a sabot will be located substantially in the nose of the projectile.

However, projectile driven by a drawer sabot are highly sensitive to transverse pressure waves and arms integral with the aft section of the sabot are required for guiding the projectile in the weapon barrel.

Such arms, the caliber of which is the same as that of the weapon, do not extend beyond the inner diameter of the bush and will not be capable of guiding the projectile in the round itself, if such a guidance is optical in the case of conventional rounds of ammunition wherein the fore section of the sabot is introduced into the weapon barrel, it becomes absolutely necessary for a telescoped round wherein a good introduction is conditioned by the control of the projectile trajectory in the round.

EP patent 0152492 describes a projectile with a tracer sabot wherein the fore section of the sabot projects outside the casing and is intended to enter into the weapon barrel. As the fore section of the projectile is in the weapon barrel as soon as the round is introduced, means for guiding the projectile in relation to the casing are thus useless.

Effectively, that patent shows arms located in the aft section of the sabot and guiding the projectile in the weapon barrel, but these arms cannot ensure guidance in relation to the casing of the round if the casing has a larger diameter than the weapon caliber.

U.S. Pat. No. 4,015,527 described a telescoped ammunition round of the same type as that shown in U.S. Pat. No. 4,802,415, namely including two distinct propellant.

The originality of the described arrangement lies in the presence of a sabot around the fins of the sub-projectile and fulfilling a gastightness function inside the casing of the round. With such an arrangement, the fin sabot is drawn into the weapon barrel and separates from the sub-projectile only after leaving the barrel, which may be detrimental to the sub-projectile stability.

U.S. Pat. No. 2,971,426 describes a loading process for an ammunition round comprising a fin-stabilized projectile.

In a second loading phase, the projectile is positioned in a tooling cylinder and a set ring is disposed at the location of the fins.

However, after installation of the projectile in the cartridge case, the rim of the set ring assumes a conical position which does not provide for the least positioning of the projectile in relation to the cartridge case.

SUMMARY OF THE INVENTION

According to a first mode of embodiment, the object of the invention is a device for holding and guiding a projectile in the cylindrical casing of a telescoped round of ammunition and comprising a sub-projectile disposed within a sabot of the same caliber as the weapon, the sabot carrying on its aft section at least three arms t the same angular distance from one another and fulfilling a guidance function inside the barrel of a weapon. This device is characterized in that it comprises, on the one hand, an annular bushing fitted to the casing and accommodating the fore section of the projectile and, on the other hand, a skim integral with the projectile and providing for the support and guidance of the projectile on the inner surface of the casing throughout its travel inside said casing, the shim separating from the projectile when it comes into contact with the ring.

Preferably the shim will comprise an annular section carrying at least three radial extensions coming into contact with the inner surface of the casing.

Advantageously the shim can be integral with the fins of the sub-projectile.

The shim can also be integral with the arms of the sub-projectile.

Preferably the arms will extend up to the fore section of the sabot.

According to a second mode of embodiment of the invention, the holding and guiding device comprises, on the one hand, an annular bushing fitted to the casing and accommodating the fore section of the projectile and, on the other hand, fingers carried by each arm, providing support and guidance for the projectile on the inner surface of the casing throughout the travel to said projectile inside said casing, each finger changing, when in contact with the bushing, from a deployed position in which it rests on the inner surface of the casing to a retracted position in which the arms carrying the fingers guide the projectile inside the weapon barrel.

According to a third mode of embodiment of the invention, the holding and guiding device comprises, on the one hand, an annular bushing fitted to the casing and accommodating at least three lugs or raised portions, integral with the bushing on aft section, at the same distance from one another, in contact with the inner surface of the casing and extending in an axial direction, the arms coming into contact with the lugs and, on the other hand, a guidance means precluding rotation of the projectile in relation to the casing.

According to a fourth mode of embodiment of the invention, the holding and guiding device comprises, on the one hand, an annular bushing of raised portions fitted to the casing and, on the other hand, at least three bulges integral with the inner surface of the casing, at the same distance from one another and extending in the axial direction, the arms resting on the bulges, and characterized in that they also comprise a guidance means precluding rotation of the projectile in relation to the casing.

According to other variants, the guidance means comprises, on the one hand, at least one plate or ridge carried by a lug or a bulge, the plate being parallel to the axis of the round, extending radially toward the inside of said round and axially substantially throughout the length of the lug or of the bulge and, on the other hand, a slot machined in each arm, the plate being accommodated in one of the slots.

The guidance means may also comprise, on the one hand, grooves machined in each lug or bulge, such grooves being parallel to the axis of the round and extending substantially throughout the length of the lug or of the bulge and, on the other hand, at least one shearpin carried by one of the arms and moving freely in one of the grooves.

BRIEF DESCRIPTION OF THE DRAWINGS

The invention will be understood more easily on reading the following description of particular modes of embodiment taken in connection with the accompanying drawings in which.

DESCRIPTION OF THE PREFERRED EMBODIMENT

Figure 1:
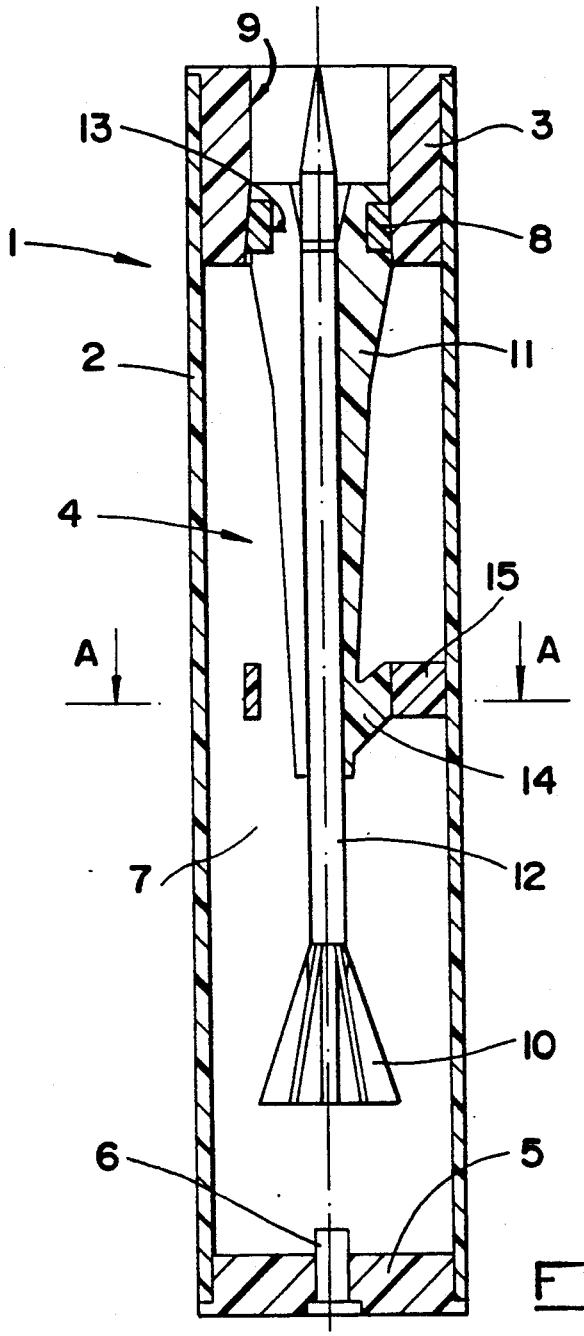
FIGS. 1 to 5 show various modes of embodiment of the holding device according to the invention.

Referring to FIG. 1, a compact ammunition round 1 comprises a casing 2, made preferably of plastic material, and closed at its aft end by a base 5, also made of plastic material, which carries an igniter 6 of a known type.

The casing contains a propellant charge 7, closed at its fore end by an annular bushing 3 also made of plastic material.

The bushing is intended to position the projectile correctly in relation to the weapon barrel (now shown).

A projectile 4 of the subcaliber type, comprises a sub-projectile 12 integral with a sabot 11, a plurality of fins 10 (usually three) for spin-stabilization wherein the sub-projectile 12 includes a known sealing means (not shown) which example a silicone coating, provides for gas-tightness may be disposed at the locations of the separations between the components of the sabot.

the fore section of the sabot is disposed in a cylindrical or slightly conical housing 9 or busing 3.

The sabot bushing fitting is of the interference fit type; the sabot 11 carries, in an annular groove 13, a band 8 intended to provide in a known manner gas-tightness in the weapon barrel.

The band 8 has a larger diameter than that of the cylindrical housing and thus provides for local deformation of the bushing.

Such a fitting ensures that the projectile will rotate only after a certain pressure level is reached inside the casing.

For the purpose of guiding the projectile inside the weapon barrel, the sabot carries on its aft section three arms 14 at the same angular distance from one another.

These arms are made integral with the inner surface of the casing 2 by means of a supporting means. This supporting means consists of a shim 15, made of plastic material, which includes an annular section 16, having at least three evenly spaced radial extensions 15*a*, 15*b*, 15*c* (see FIG. 1*a*).

Figure 1A:
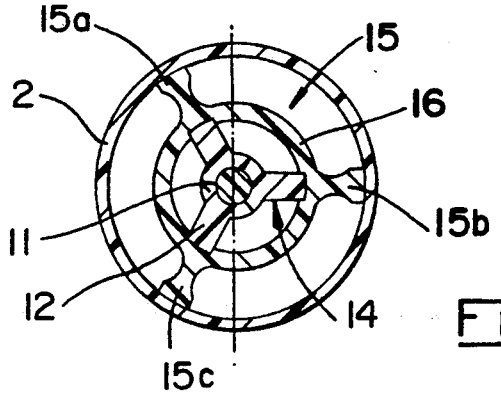
FIG. 1A is a cross-sectional view of FIG. 1 in plane A—A.

As shown in FIG. 1*a* the shim may be connected by threads disposed on appropriate adjacent surfaces, but any other means could be envisaged, for example, by gluing or by using interference fit.

The connecting means will break when the arm enters into the bushing and the shim will then be ejected behind the sabot and will not disturb the sub-projectile trajectory. The arms will guide the sub-projectile inside the weapon barrel.

Figure 2:
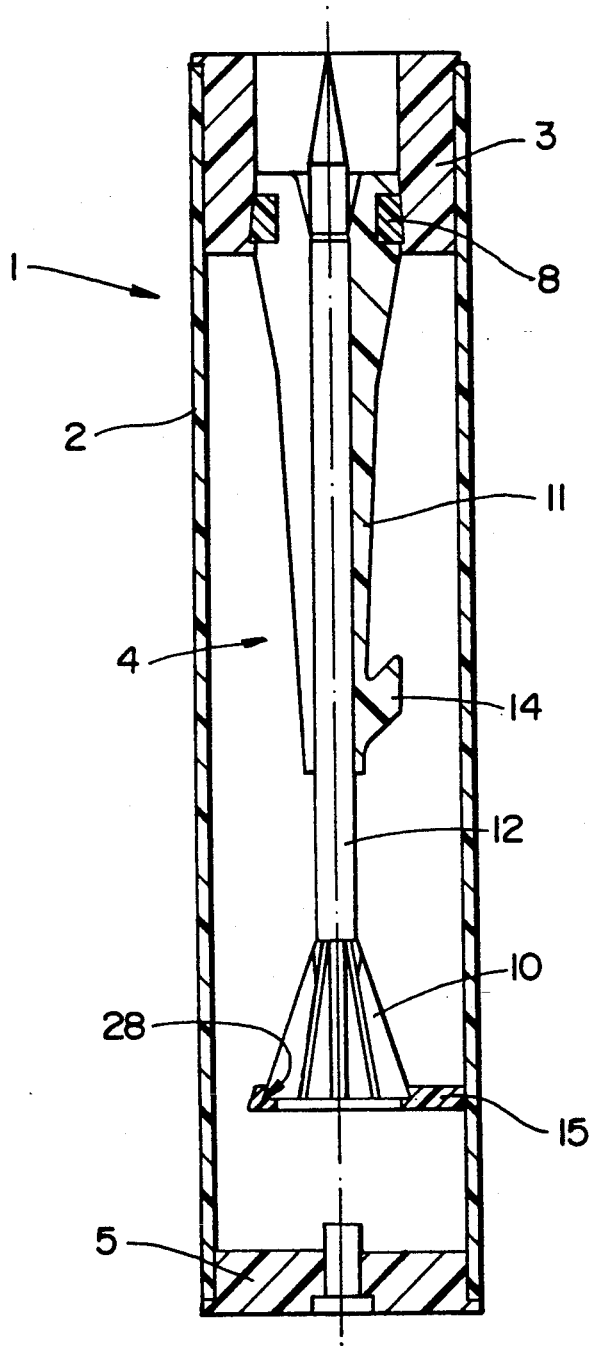

On the round of ammunition as shown in FIG. 2, the shim 15 is made integral with the projectile at the location of the fins 10.

The fitting is of the interference fit type and the annular section 16 of the shim 15 has a conical inner profile 28 supporting the external edges of the fins 10.

Figure 2A:
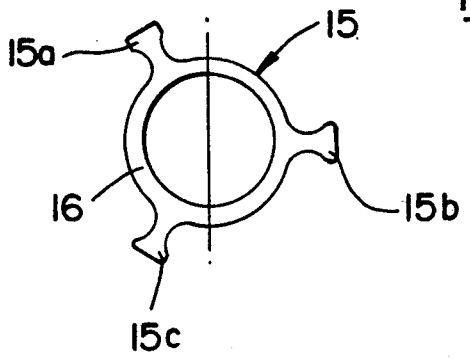
FIG. 2A is a front view of the shim along which is used in the variant of FIG. 2.

As in the previous variant, the shim includes three evenly spaced arms 15*a*, 15*b*, 15*c* (see FIG. 2A), and the sub-projectile is guided without substantially reducing the volume reserved for the propellant charge.

The shim will be mounted on the fins, and will separate from the fins when the sub-projectile passes through the bushing and will be ejected behind the sabot without disturbing the sub-projectile trajectory.

Figure 3:
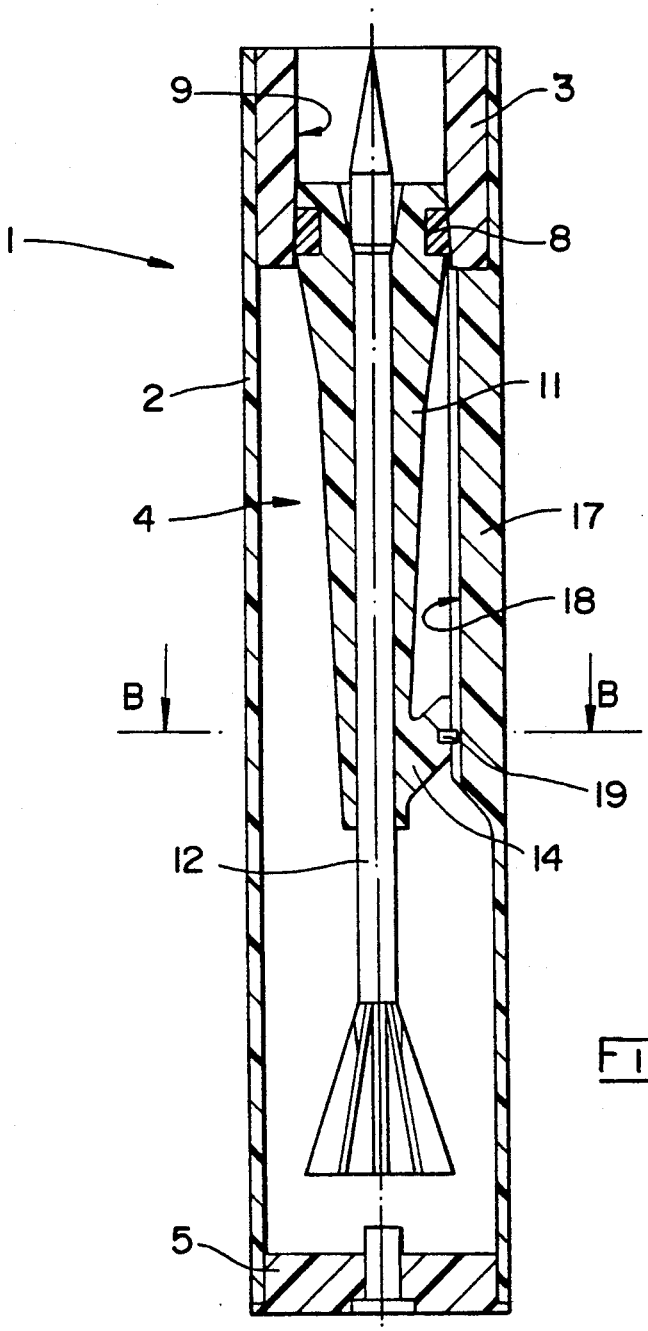

On the round of FIG. 3, the casing 2 includes three bulges 17 at the same distance from one another and extending in an axial direction. Each bulge includes a groove 18 parallel to the axis of the round and extends substantially throughout the length of the bulge.

At least one of the arms 14 includes a shear-pin 19 moving freely inside one of the grooves so as to provide guidance in translation and thus preclude rotation of the projection in relation to the casing.

Figure 3A:
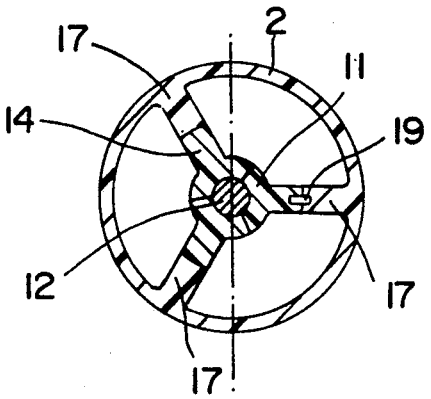
FIG. 3A is a cross-sectional view of FIG. 3 in plane B—B.

The bulges constitute the arms rest means, their thickness is reduced (see FIG. 3A), thus substantially not reducing the volume reserved for the grain charge.

Also, to keep the arms ends in contact with the bulges, a guidance means consisting of the pin and the grooves, is necessary.

Only one pin is necessary, but it will be convenient to provide for each groove or bulge in order to avoid a projectile/casing indexing, which would complicate the manufacturing process.

Figure 4A:
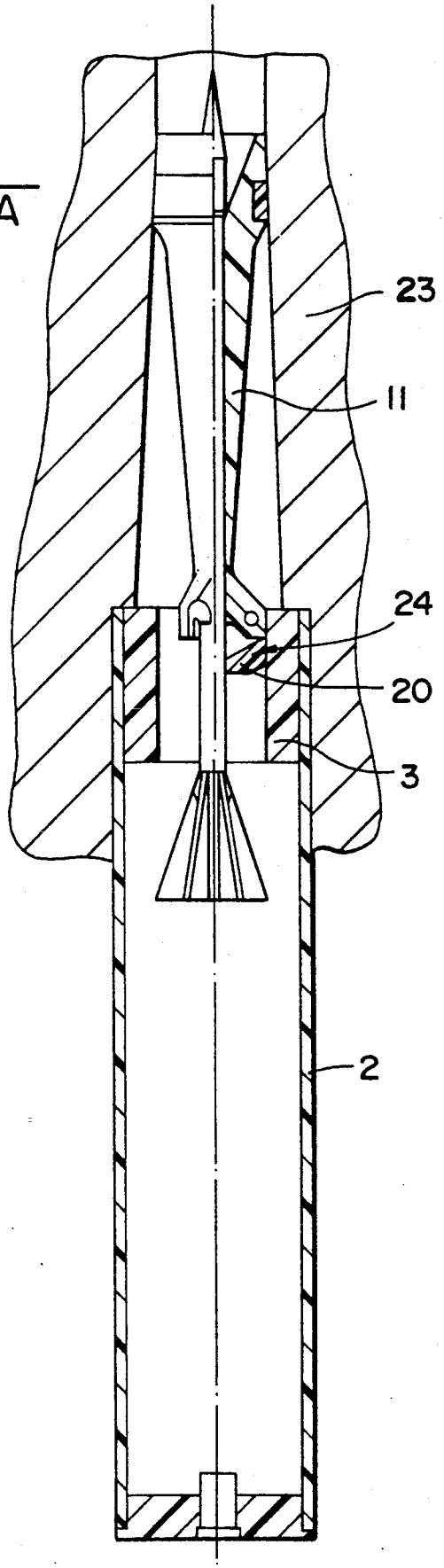
FIG. 4A shows the round of ammunition of FIG. 4 after ignition of the propellant charge, when the projectile is about to leave the casing.
Figure 4:
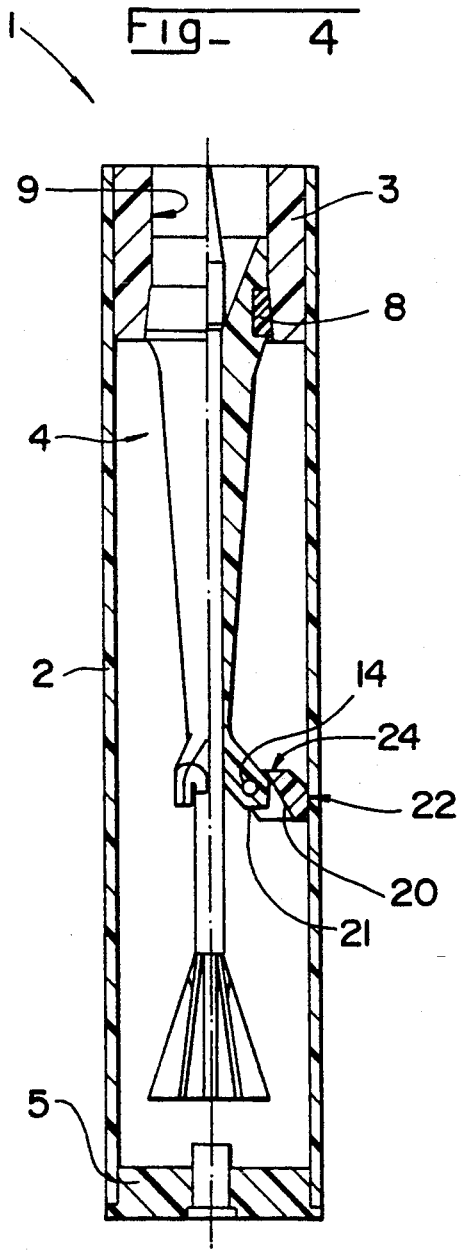

The pins are sized so as to be sheared during their travel through the cylindrical housing 9 of the bushing. Also, are ejected after the projectile so as not to disturb its trajectory and the operation of the weapon.

referring to FIG. 4, the rest means consist of fingers 20 carried by each arm 14 capable of tilting in a radial plane about an said integral with the arm.

A latch 21 (which, in this case, is a pin, see FIG. 4B) secures the fingers in a deployed position shown on FIG. 4. In this position, the outer ends 22 of the fingers 20 rest on the inner cylindrical surface of the casing 2.

When the projectile leaves the casing, the fingers 20 strike the bushing 3, which results in the shearing of the latches 21 and causes the fingers to change to the retracted position shown on FIG. 4A.

FIG. 4A shows the projectile when it leaves the casing; the fingers 20 are tilted in relation to the sabot 11 and do not disturb the passage of the aft section of the projectile when the latter enters the weapon barrel as shown as 23.

Then the projectile carries the finger into the weapon barrel, and the arms carrying the fingers can guide the projectile inside the barrel.

Figure 4B:
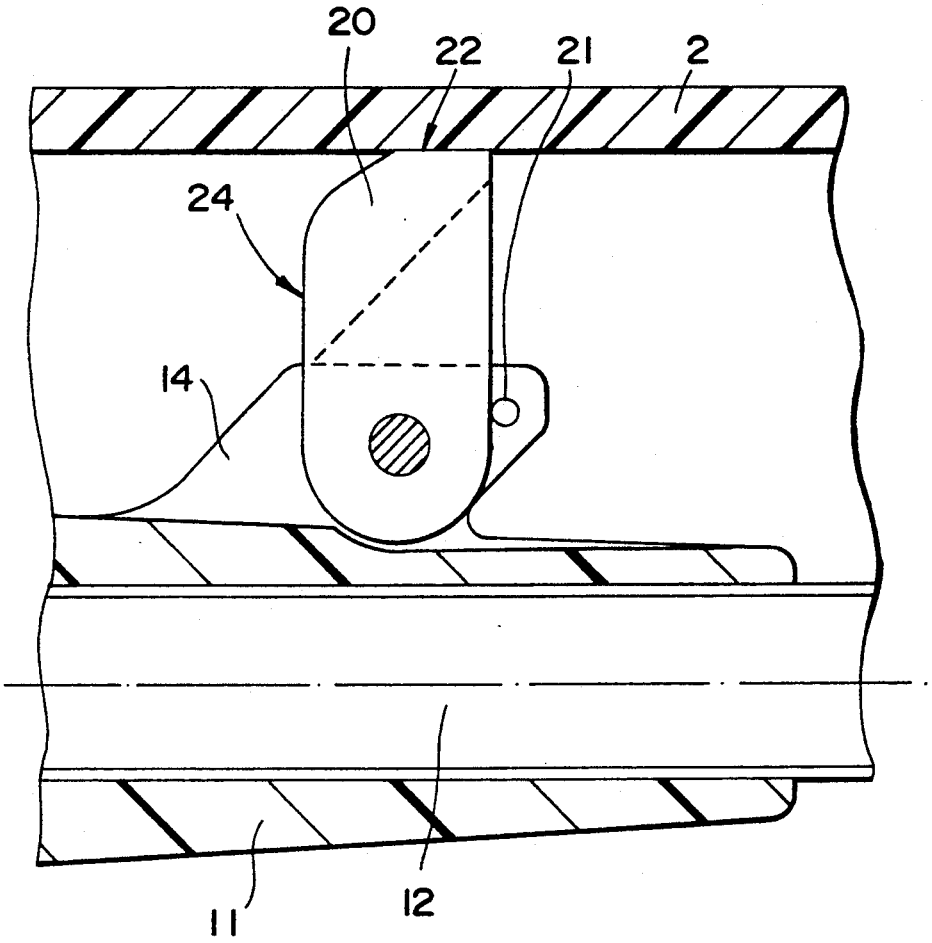
FIG. 4B is an enlarged view of the latch of FIG. 4.

Such an arrangement makes it possible, if necessary, to increase the surface on which the projectile is guided inside the weapon barrel by shaping the fingers so that, in retracted position, their heels 24 are in prolongation of the ends of the arms 14 (see FIG. 4B).

Figure 5:
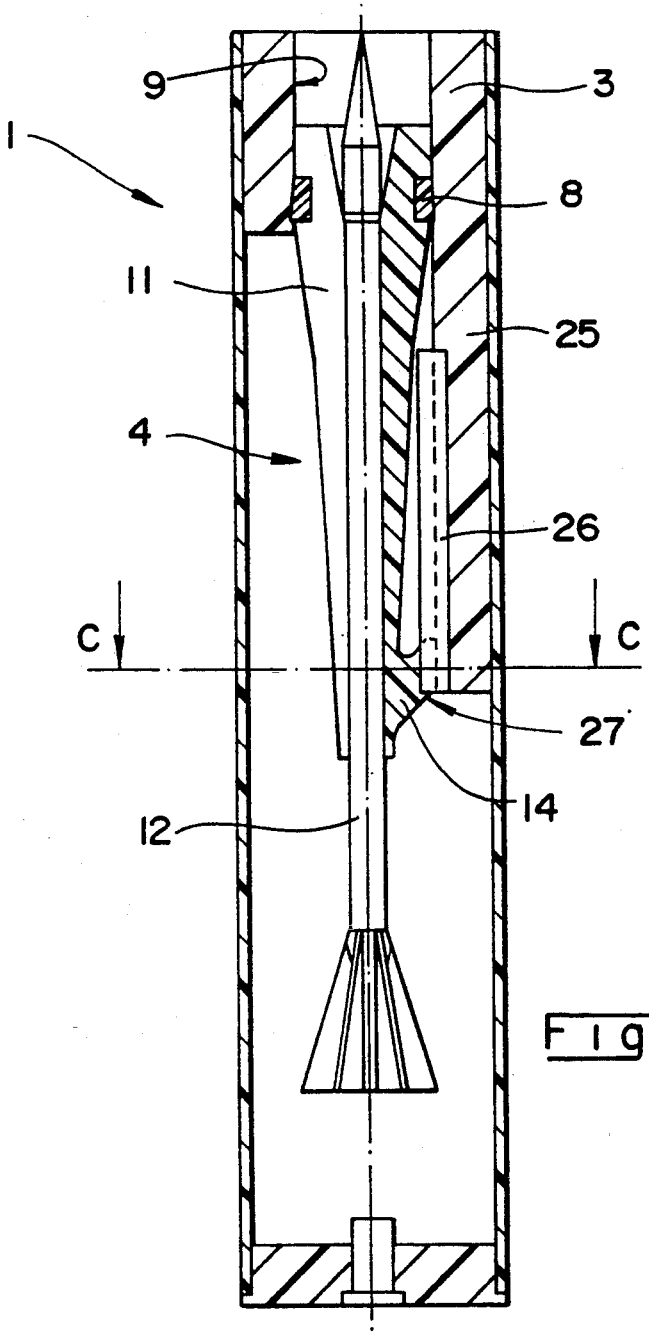

In the mode of embodiment shown in FIG. 5, the bushing carries, on its aft section, three evenly spaced lugs 25 in contact with the inner surface of the casing and extending in an axial direction.

At least one lug carries a metallic rectangular plate 26, parallel to the round axis, extending radially toward the inside of the latter and axially substantially throughout the length of the lug.

The plate(s) is/are positioned during the bushing injection. Each of the three arms includes a slot 27.

Figure 5A:
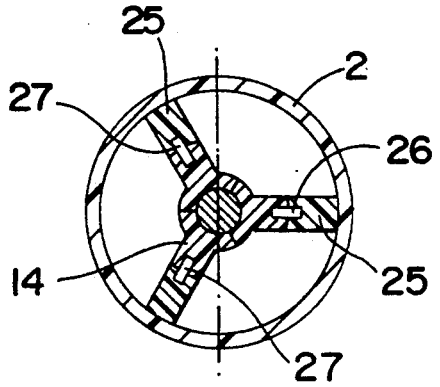
FIG. 5A is a cross-sectional view of FIG. 5 in plane C—C.

The plate(s) is/are accommodated in the slot(s) so as to provide guidance in translation and thus to preclude rotation of the projectile in relation to the casing (see FIG. 5A).

The ends of the arms 14 rest on the corresponding lug 25. The length of the plate(s) is (are) such that the plate(s) release(s) the arms when the band 8 of the projectile has entered into the weapon barrel.

In this variant, the lugs constitute the arms rest means and reduce lug length (see FIG. 5A), which makes it possible to maintain the volume reserved for the propellant charge. Also to keep the ends of the arms in contact with the lugs, it is necessary to provide for a guidance means consisting of the plate and the grooves.

The main advantage of this variant of embodiment is that it does not require the installation of a shear pin integral with the arms.

It would also be possible to make the plate from a plastic material which could be the same as the material used for the bushing.

It would be possible to combine the guidance means consisting of the plates and the slots machined in the arms with the rest means consisting of the bulges and, conversely, to provide lugs integral with the bushing fitted with grooves.

Figure 6:
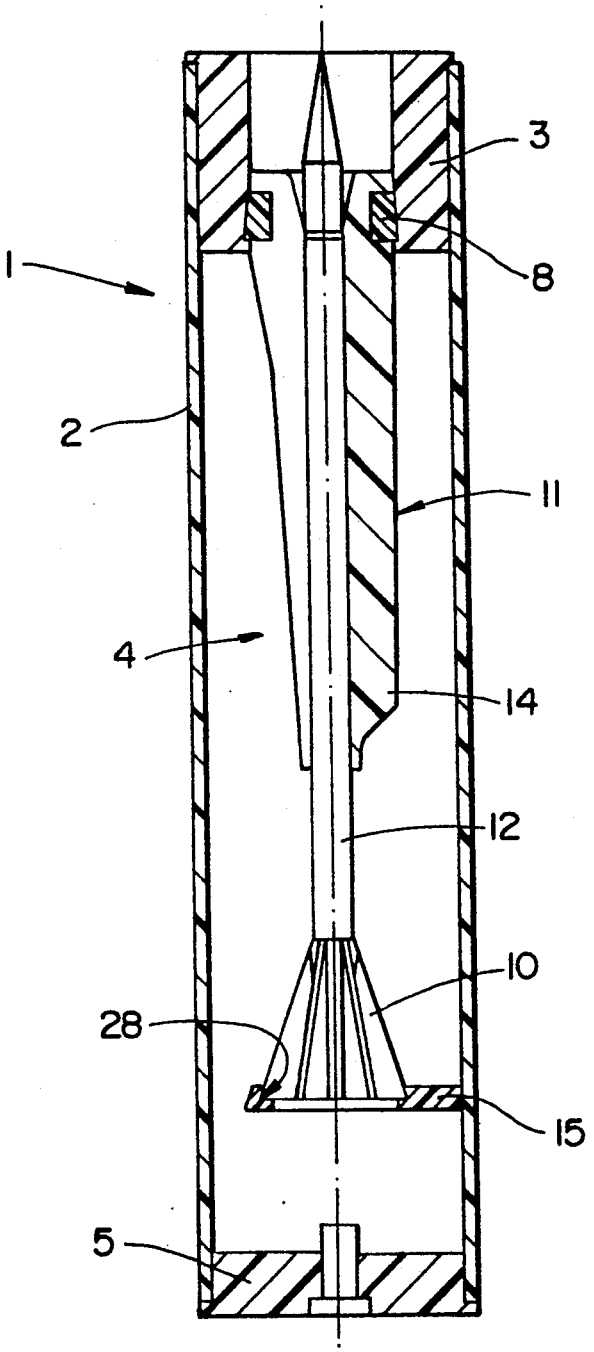
FIGS. 6 and 6A show a preferred variant of the invention.

FIG. 6 illustrates a variant of embodiment of the round shown on FIG. 2.

In this particularly interesting variant, the arms 14 extend up to the fore section of the sabot 11 while the shim 15 is integral with the fins 10 of the sub-projectile.

Figure 6A:
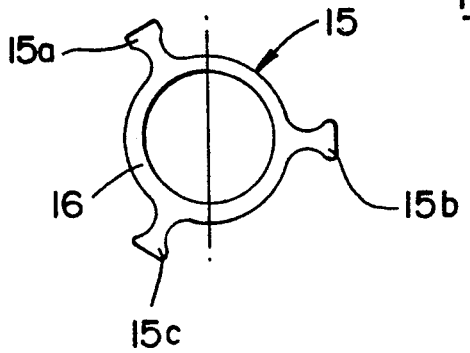

The shim is shown in more detail in FIG. 6A.

The advantage of such an arrangement is that it guides the projectile 4 in relation to the bushing 3 throughout the projectile travel in the casing of the round, which ensures continuous guidance when the projectile moves from the casing to the weapon barrel.

We claim:

1. A device for holding and guiding a subprojectile in a cylindrical casing and in a weapon barrel comprising:

a sabot having a sub-projectile disposed within said sabot;

a cylindrical casing within which is disposed a projectile, said projectile comprising the sub-projectile and the sabot, said sabot having a plurality of angularly equispaced arms substantially at its aft section for providing stability and guidance to the projectile inside a weapon barrel;

means within the casing for providing stability and guidance to an aft section of the projectile within the casing substantially along an entire length of the casing, said means being defined by a shim integral with the projectile and said shim including a plurality of radial extensions which define through openings therebetween and are in sliding contact with said casing, a propellant charge located forward and rearward of said shim; and an annular bushing within a fore section of the cylindrical casing cooperating with a corresponding fore section of said sabot for providing sub-projectile stability.

2. The device of claim 1, wherein said shim is separable from the projectile upon contact with the annular bushing.

3. The device of claim 2, wherein said shim is integral with said sabot.

4. The device of claim 2, wherein said sub-projectile has fins substantially in an aft section of said sub-projectile, wherein said shim is integral with said fins.

5. The device of claim 1, wherein said arms extend up to the fore section of the sabot.

* * * * *